US005470297A

United States Patent [19]

Park

[11] Patent Number: 5,470,297

[45] Date of Patent: Nov. 28, 1995

[54] AEROBIC EXERCISE EQUIPMENT

[76] Inventor: John Park, 5 Paulding La., Crompond, N.Y. 10517

[21] Appl. No.: 259,243

[22] Filed: Jun. 13, 1994

[51] Int. Cl.[6] ..... A63B 21/045

[52] U.S. Cl. ..... 482/127; 482/130; 482/137; 482/138

[58] Field of Search ..... 482/127, 130, 482/138, 142, 95, 96, 133, 137, 72

[56] References Cited

U.S. PATENT DOCUMENTS

| | | | |
|---|---|---|---|
| D. 263,978 | 4/1982 | Brentham . | |
| D. 271,603 | 11/1983 | Berner . | |
| 4,641,833 | 2/1987 | Trethewey | 482/72 |
| 4,684,126 | 8/1987 | Dalebout et al. | 482/72 |
| 4,722,525 | 2/1988 | Brentham | 482/137 |
| 4,850,585 | 7/1989 | Dalebout . | |
| 4,940,233 | 7/1990 | Bull et al. . | |
| 4,949,958 | 8/1990 | Richey | 482/96 |
| 5,098,085 | 3/1992 | Abboudi et al. . | |
| 5,217,420 | 6/1993 | Abboudi et al. . | |
| 5,277,684 | 1/1994 | Harris | 482/137 |

FOREIGN PATENT DOCUMENTS 499228 8/1992 European Pat. Off. .

OTHER PUBLICATIONS

Greater Freedom for the Elderly, *Design News,* Jun. 1993, pp. 124–125.

Pro Form Inc., brochure for Aerobot exerciser.

Aquastyle Inc., brochures for Aquarow and Aquatrack

World Sporting Goods, Inc., brochure for Knee Developer (May, 1979).

*Primary Examiner*—Lynne A. Reichard

*Attorney, Agent, or Firm*—Leo Zucker

[57] ABSTRACT

Aerobic exercise equipment includes a frame body having a base portion that rests on a floor surface, and a seat portion. Shaft portions fixed with respect to the frame body define pivot axes aligned with a front edge of the seat portion. A pair of arm exercise bars are mounted each at a side of the seat portion to swing forward about first shaft portions when the person grips the bars while seated. A pair of leg exercise bars are also mounted each at a side of the seat portion to swing upward about second shaft portions when the seated person's feet are urged against the leg exercise bars. In a preferred embodiment, all of the shaft portions on which the arm and the leg exercise bars are mounted have a common axis, and adjacent arm/leg exercise bars at the sides of the seat portion have an associated torsion spring and limit stop mechanism. Adjustable paddle assemblies are used in place of the spring mechanisms in an underwater version of the equipment.

15 Claims, 6 Drawing Sheets

100
36A'
36B'
102
120
22'
SB
120
102
30A'
30B'
120
102
50A'
56A
14A'
50B'
120
102
56B
12'
54A'
54B'
14B'
106A
106
106A
104

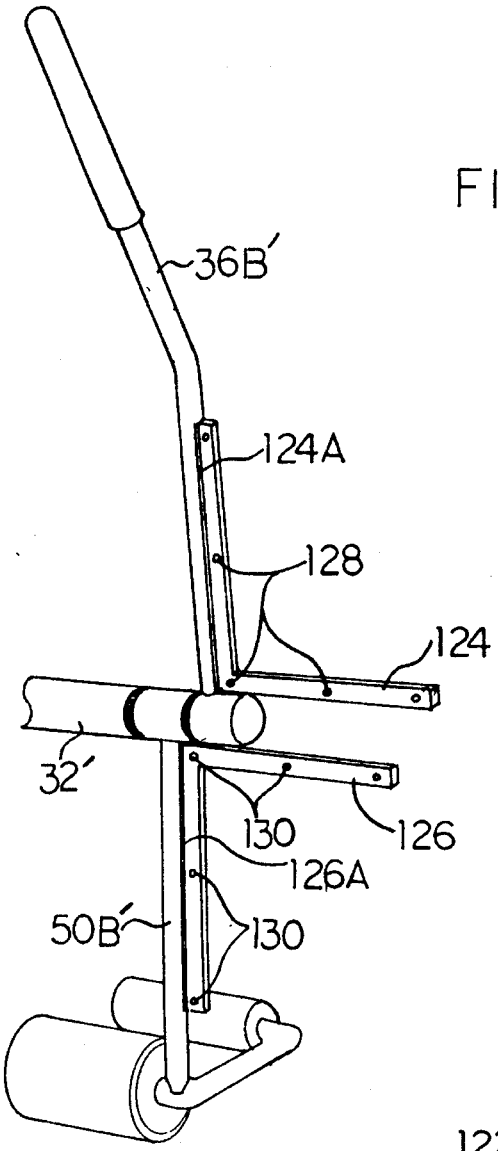
FIG. 6
FIG. 5
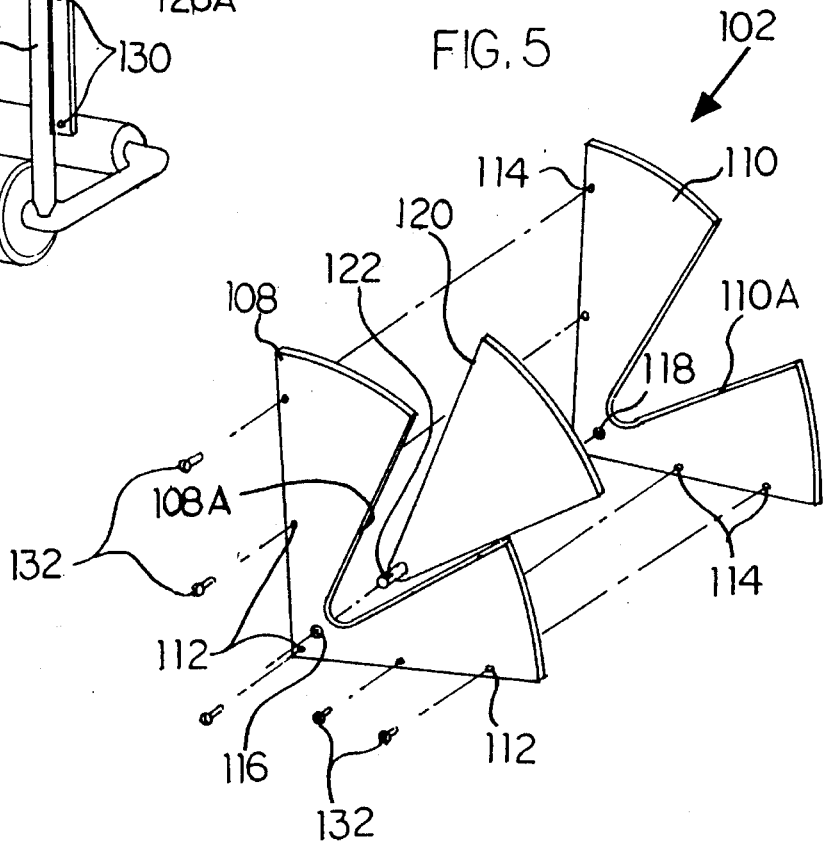

AEROBIC EXERCISE EQUIPMENT

BACKGROUND OF THE INVENTION

1. Field of the Invention

The present invention relates generally to exercise apparatus, and particularly to aerobic exercise equipment that enables a person to exercise their arms and legs while in a seated position.

2. Description of the Known Art

Persons today are very aware of the need to exercise on a regular basis as a means for staying physically fit and healthy. In recent years there has been a proliferation of various kinds of exercise equipment for use at health fitness centers and at home. Such equipment has also been developed for use in an aquatic environment in which a person who, for example, may be recovering from a bone injury can perform rehabilitating exercise while partially submerged so as to avoid undesirable stress or shock in the region of the injury while working out.

A thorough cardiovascular or aerobic workout on a regular basis is particularly beneficial to elderly persons. The key to good health and longevity is regular exercise, and elderly persons need to exercise more than others to stay healthy. Yet, as a person ages, exercising may become more difficult. Accordingly, there is a need for aerobic exercise equipment that is configured to meet a mature individual's special needs that may be brought on because of physical restrictions and limitations of the individual. It has also been found that providing aerobic exercise equipment for use in an aquatic environment provides a safe workout for such individuals as well.

Because of the buoyancy of a person's submerged body, undesirable stresses that would otherwise be exerted at the joints and other body parts when working out on land, are significantly reduced. Also, because resistance to an individual's body motions may be developed not by weights or springs but simply from the drag of certain moving parts of an underwater exerciser, there is no danger of over exertion. Further, an aquatic workout provides a natural cooling mechanism for the individual.

An exercise machine for use on land, including a seat, a pair of swivelable arm exercise bars pivoted beneath the forward portion of the seat, and a pair of swivelable foot pedals mounted remotely from the forward edge of the seat, is known by the designation "Aerobot", from ProForm, Inc. of Beaverton, Oreg. The front edge of the seat is supported relatively close to the floor, and a seated person's legs can not swing the foot pedals in an upward motion.

Various patented above-ground equipment including a seat, arm exercise bars or levers with hand grips, and leg exercise bars, are known. For example, U.S. Pat. No. 263,978 (Apr. 20, 1982) illustrates a physical exerciser having a "U"-shaped exercise bar, with hand grips at the ends of the bar extending above the forward edge of the seat. The bar extends transversely below the seat and is connected to a bottom hinge joint through a support member joined at the middle of the bar. The exercise bar is also pivoted to the free end of an hydraulic piston shaft, so that a preset force must be exerted on the hand grips to move the bar.

The exerciser of the '978 patent also shows a generally "V"-shaped bar pivoted at one free end near the forward edge of the seat with the other end facing down in a vertical plane. The bar has foot-engaging pads projecting sideways, and is pivoted to the free end of another hydraulic piston shaft. The patented exerciser is not constructed so as to permit independent movement of the arms while a person holds the hand grips, and the person's legs must move in unison as well while the feet are positioned in the foot pads.

U.S. Pat. No. 271,603 (Nov. 29, 1983) shows a physical exerciser having a single, pivoted leg pad support assembly disposed below the seat with an hydraulic piston arrangement similar to that of the '978 patent.

Exercise apparatus for use underwater is known from U.S. Pat. No. 5,217,420 (Jun. 8, 1993) which in one embodiment provides a base frame to be disposed at the bottom of a pool of water, a seat, and a pair of L-shaped poles pivoted beneath the seat and arranged to be moved independently to simulate a "rowing" motion. A pair of flaps are mounted on the poles to provide resistance to movement of the poles through the water. A similar arrangement is shown in U.S. Pat. No. 5,098,085 (Mar. 24, 1992).

A striding exerciser shown in U.S. Pat. No. 4,850,585 (Jul. 25, 1989) is arranged to allow a user to stand on foot supports and move his or her legs in a striding-type motion while gripping a pair of arm members that are fixed to the leg supports at common hubs. The hubs are pivoted in line at the top of a frame, and the user is supported by the frame while standing on the foot supports and gripping the arm members.

Aerobic conditioning apparatus in U.S. Pat. No. 4,940,233 (Jul. 10, 1990) is also adapted to accommodate a user while standing on swivelable foot engaging plates and griping a pair of upwardly extending swivelable members. The foot and hand engaging members of the apparatus are interconnected to move synchronously. As mentioned, the apparatus of the '585 and '233 patents is designed for use by a person standing in an upright position, and the person's leg and arm movements are coordinated by means in the apparatus.

SUMMARY OF THE INVENTION

An object of the invention is to provide aerobic exercise equipment capable of providing a safe and healthy workout for persons of all ages.

Another object of the invention is to provide aerobic exercise equipment that allows the arms and the legs to perform exercising movements independently of one another, allowing the user to have full range of motion.

Another object of the invention is to provide aerobic exercise equipment that enables a user, while seated, to perform a total body cardiovascular aerobic exercise, and to perform an exercise for developing the stomach muscles.

Yet another object of the invention is to provide aerobic exercise equipment having arm and leg exercise bars mounted to be swung about a common axis aligned with the front edge of a seat.

According to the invention, aerobic exercise equipment includes a frame body defining a base portion, and a seat portion over the base portion to support a seated person above a floor on which the base portion rests. Shaft portion means fixed with respect to the frame body, define pivot axes aligned with a front edge of the seat portion.

A pair of arm exercise bars are mounted each at a side of the seat portion to swing about a pivot axis, the arm exercise bars having grip portions that can be grasped by the seated person. A pair of leg exercise bars are mounted each at a side of the seat portion to swing about a pivot axis, while the leg exercise bars are engaged with the seated person's feet.

Preferably, the arm and the leg exercise bars are mounted to be swung about a common axis, and adjacent arm/leg exercise bars at the sides of the seat portion have an associated spring action and limit stop mechanism. In an underwater version of the equipment, specially adjustable drag paddle assemblies on the exercise bars take the place of the spring mechanisms.

For a better understanding of the present invention, together with other and further objects, reference is made to the following description taken in conjunction with the accompanying drawing, and the scope of the invention will be pointed out in the appended claims.

BRIEF DESCRIPTION OF THE DRAWING

In the drawing:

FIG. 5 is an exploded view of a paddle assembly provided on the equipment of FIG. 4;

FIG. 6 is a partial perspective view of paddle assembly mounts in the equipment of FIG. 4;

DETAILED DESCRIPTION OF THE INVENTION

Figure 1:
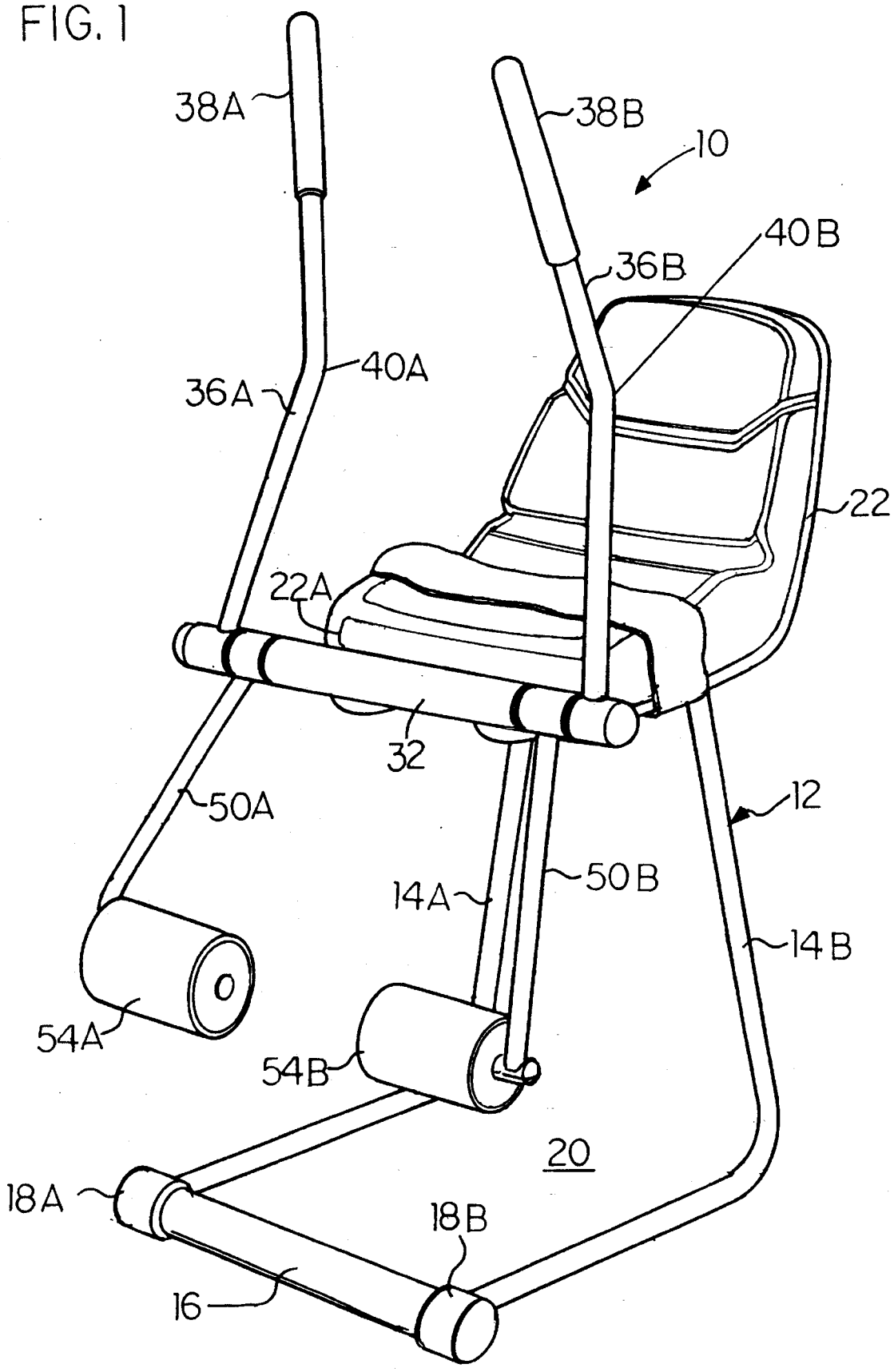
FIG. 1 is a perspective view of aerobic exercise equipment according to the present invention.

FIG. 1 is a perspective view of aerobic exercise equipment 10 according to the present invention.

The equipment 10 has a frame body 12 formed of left and right, generally "C"-shaped tubular members 14*a*, 14*b*. The lower portions of the tubular members 14*a*, 14*b* are joined at their ends to opposite ends of a cross bar 16. Left and right rubber end caps 18*a*, 18*b* are provided to cap the ends of cross bar 16 and to prevent scratching of a floor surface 20. See also FIG. 2.

The cross bar 16, end caps 18*a*, 18*b* and the lower portions of the C-shaped tubular members 14*a*, 14*b* define a base portion of the frame body 12 for resting on the floor surface 20. The frame body 12 also forms a seat portion over the base portion, to support a person (not shown) in a sitting position at a certain height H (FIG. 3) above the floor surface 20.

Figure 2:
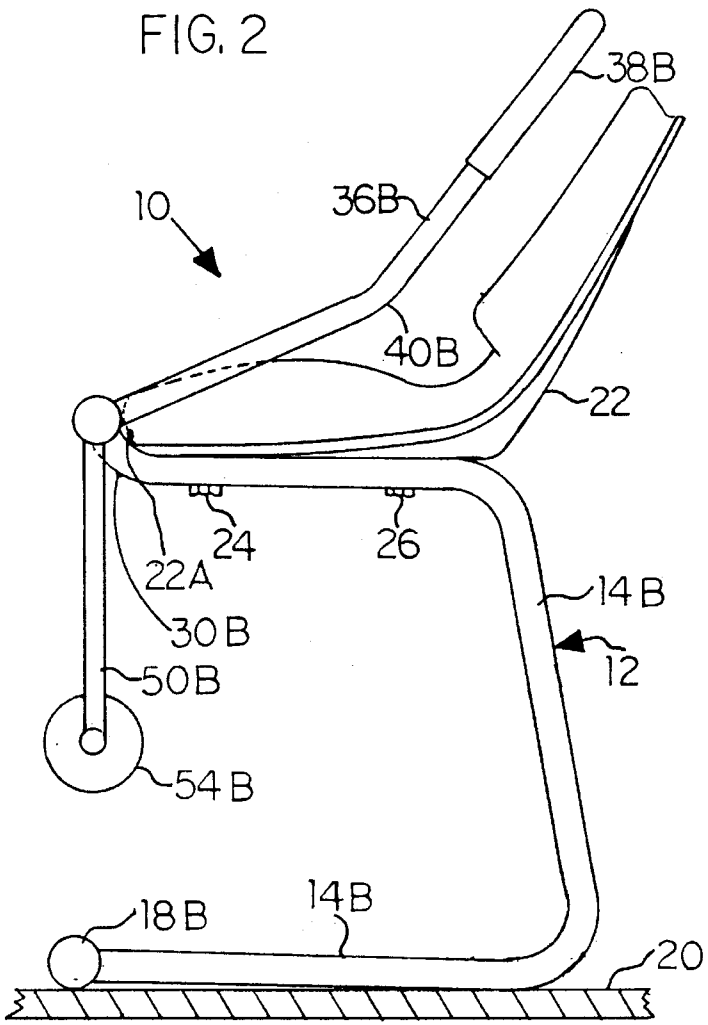
FIG. 2 is an elevational view of the present exercise equipment as seen from the right side in FIG. 1.

Upper portions of the tubular members 14*a*, 14*b* cooperate to form a mount for a seat 22 a forward edge 22*a* of which faces in the direction of the open side of the "C" formed by tubular members 14*a*, 14*b*. Seat 22 is fastened in place by way of, e.g., a set of bolts that pass through corresponding openings through the walls of the tubular members 14*a*, 14*b* and engage mating threaded openings in the seat bottom. Two seat bolts 24, 26 are shown in FIG. 2 through the tubular member 14*b*. A corresponding number of seat bolts (not shown) also pass through the tubular member 14*a*.

Tubular members 14*a*, 14*b* of the frame body 12 have upper end portions 30*a*, 30*b* that curve upwardly adjacent the seat forward edge 22*a*, and which portions are joined (e.g., by welding) to a cylindrical cross member 32. Cross member 32 extends in alignment with the seat forward edge 22*a*, and supports pivot shaft portions 34*a*, 34*b* that extend in axial alignment from the left and the right ends of the cross member 32 as viewed in FIG. 3.

Figure 10:
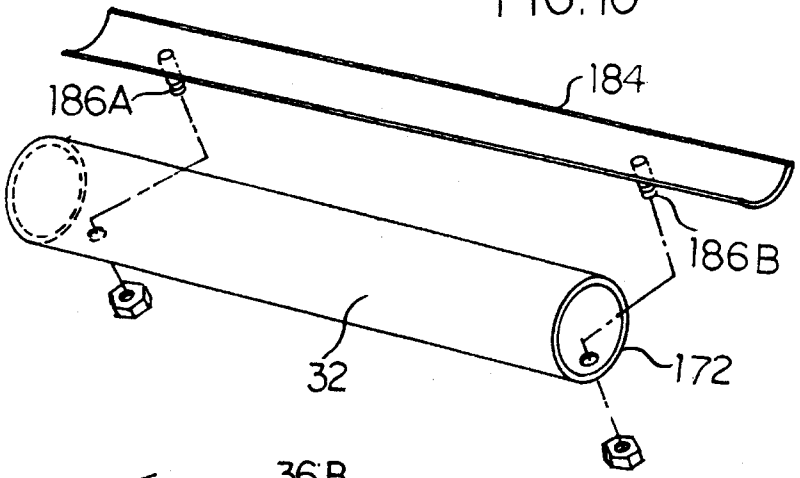
FIG. 10 is an assembly view of part of a cross member in the equipment of FIGS. 1–3, and an interior spring retaining and limit stop member.
Figure 11:
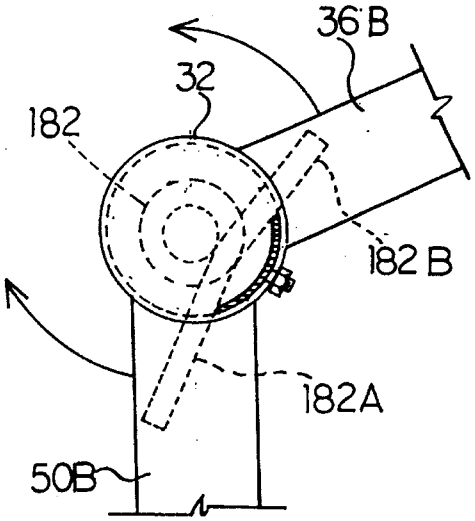
FIG. 11 is a partial side elevational view of the mounting arrangement of FIG. 9.
Figure 9:
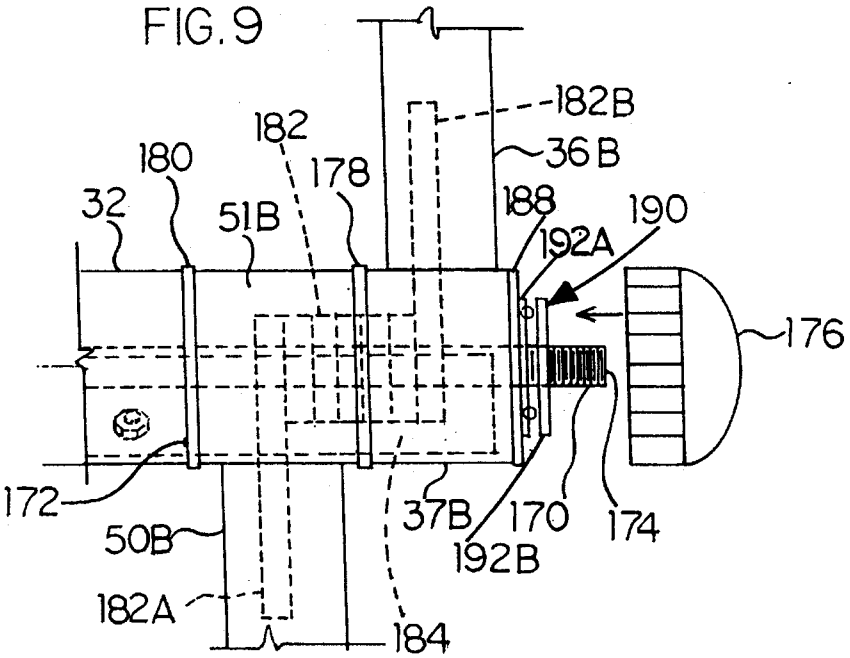
FIG. 9 is a partial front elevational view of a mounting arrangement for arm and leg exercise bars in the equipment of FIGS. 1–3.

A pair of arm exercise bars 36*a*, 36*b* are mounted each at one end for swivelling movement about a corresponding one of the pivot shaft portions 34*a*, 34*b*. Details of the mounting arrangement of the arm exercise bars 36*a*, 36*b* about the shaft portions 34*a*, 34*b* are shown in FIGS. 9–11. Each arm exercise bar is formed of one-inch diameter tubular steel stock and has a hand grip portion 38*a*, 38*b* at the end remote from the pivot shaft portions 34*a*, 34*b*. The arm exercise bars are preferably formed each with 30 degree bends 40*a*, 40*b* at their central regions, as depicted in the drawing.

Bends 40*a*, 40*b* extend over a 30 degree arc in the vertical plane, perpendicular to the axes of pivot shaft portions 34*a*, 34*b*. With the pivoted ends of the bars 36*a*, 36*b* located at each side and just forward of the seat edge 22*a*, bends 40*a*, 40*b* preferably begin at a distance of about 12 inches from the pivot axes.

With the arm exercise bars 36*a*, 36*b* mounted relative to the seat 22 as described, a person sitting in the seat 22 will be able to grasp the hand grip portions 38*a*, 38*b* while seated, and urge each bar forward about the pivot shaft portions 34*a*, 34*b* independently against a torque created by a spring action mechanism associated with the cross member 32. See FIGS. 9–11.

A pair of leg exercise bars 50*a*, 50*b* are mounted for swiveling movement about the axes of the pivot shaft portions 34*a*, 34*b* at end bushings 51*a*, 51*b* of the bars. Each leg exercise bar is formed of, e.g., one-inch O.D. tubular steel stock and has a foot pad support member 52*a*, 52*b* projecting at right angles at the remote end of the bar. Foot engaging pads 54*a*, 54*b* are mounted coaxially on the support members 52*a*, 52*b* to act as a cushion against the insteps of a seated person's feet as the person urges the bars 50*a*, 50*b* to swing upward.

The end bushings 51*a*, 51*b* of the leg exercise bars 50*a*, 50*b* have an associated spring torsion mechanism as described in connection with FIGS. 9–11. Accordingly, when a person is sitting on the seat 22 and urges his or her feet against the pads 54*a*, 54*b* at the ends of leg exercise bars, the person can swing the bars upward independent of one another against a determined resistance.

The frame body 12 is constructed and arranged so that the height H of the seat portion above the floor surface 20, and the position of the pivot shaft portions 34*a*, 34*b*, are such that the seated person can swing their legs about the knees from a position where the feet approach the floor beneath the seat edge 22*a* while urged against the foot pads 54*a*, 54*b*; to a position where the legs extend straight.

Figure 3:
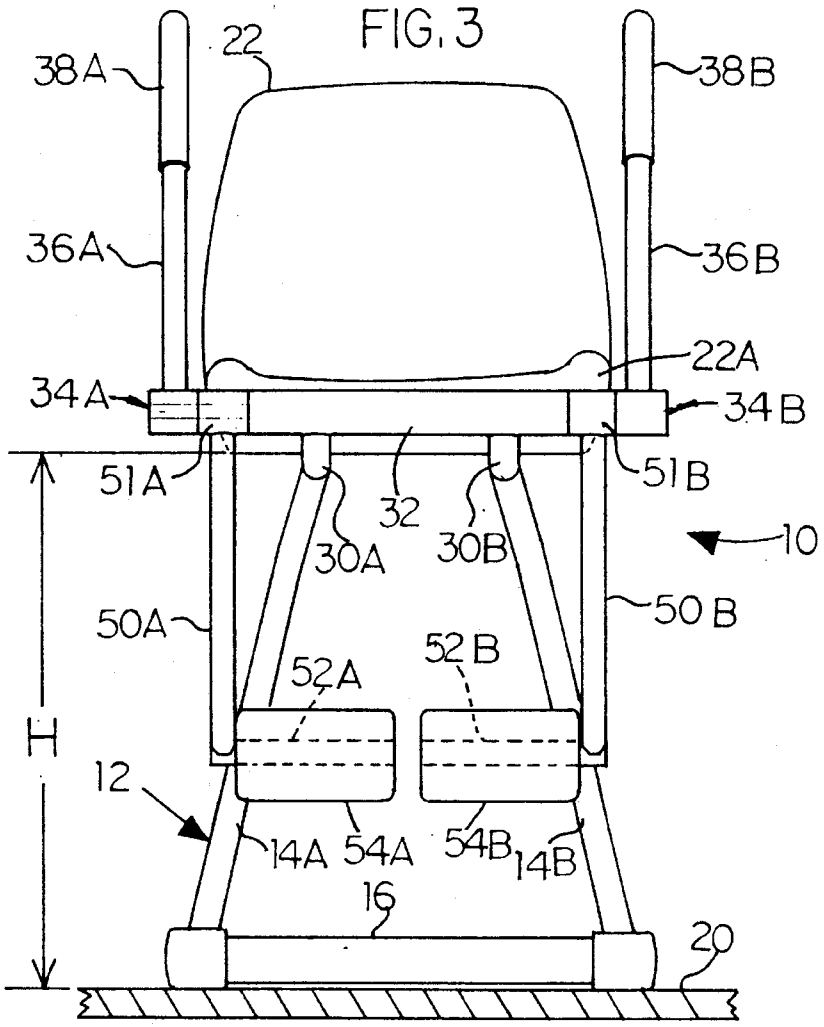
FIG. 3 is an elevational view of the present exercise equipment as seen from the front in FIG. 1.
Figure 4:
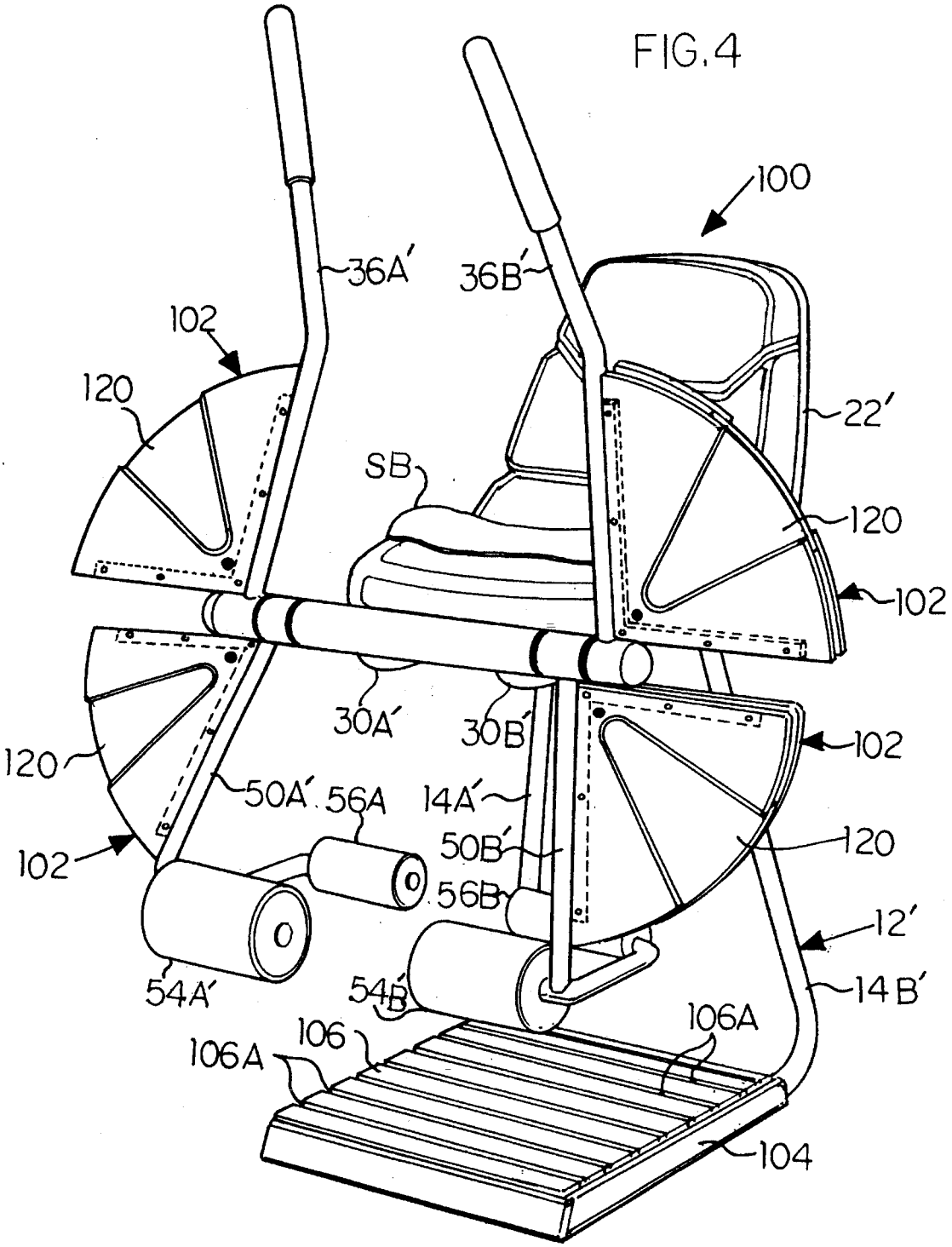
FIG. 4 is a perspective view of another embodiment of the present exercise equipment for use in the water.

FIG. 4 is a perspective view of another embodiment of aerobic exercise equipment 100. Parts of the equipment 100 that are similar to parts of the exercise equipment 10 of FIGS. 1–3, have corresponding reference characters.

The exercise equipment 100 differs from the equipment 10 primarily in that the equipment 100 is intended for use with the frame body 12' and seat 22' submerged in water. Seat 22' has an associated seat belt SB to keep a seated person in place on the seat when sitting below water level. The seat belt SB can be secured about the person by way of VELCRO pads that are not affected by moisture. Instead of the torsion spring mechanism of FIGS. 9–11, the equipment 100 uses paddle assemblies 102 to drag or resist the swinging of arm and leg exercise bars 36*a*', 36*b*' and 50*a*', 50*b*' while the equipment is submerged. The paddle assemblies are fixed to the exercise bars as shown in FIG. 4. Also, a pair of heel support pads 56*a*, 56*b* are supported on fixed bars extending parallel to and behind the foot (instep) pads 54*a*', 54*b*'.

The base portion of the frame body 12' has a stainless steel platform 104 that straddles the lower portions of left and right frame members 14*a*', 14*b*'. A rubber platform pad 106 is adhered to the top of the platform 104, the pad having a set of parallel grooves 106*a*. It is preferred that all parts of the exercise equipment 100 be formed of materials that are rust proof or otherwise impervious to water in which chemicals such as chlorine and other pool water additives may be present.

FIG. 5 is an exploded view of one of the paddle assemblies 102.

The paddle assembly 102 includes a pair of cover plates 108, 110, each in the shape of a quarter-circle and having generally triangularly-shaped sector openings 108*a*, 110*a*. Cover plates 108, 110 have screw hole openings 112, 114 along their radial edges which openings, like the sector openings 108*a*, 110*a*, are in registration with one another when the cover plates 108, 110 are aligned. The cover plates 108, 110 also have pivot hole openings 116, 118 adjacent and aligned radially with the vertices of the sector openings 108*a*, 110*a*.

Each of the paddle assemblies 102 also includes a generally triangularly-shaped control plate 120 with a pivot shaft 122 projecting normally on both sides of the plate 120 near the vertex of the plate. When assembled, the cover plates 108, 110 of the paddle assembly 102 contain the control plate 120 with the pivot shaft 122 of the control plate passing through the pivot hole openings 116, 118 in the cover plates. The angular dimensions of the control plate 120 from its vertex are slightly larger than those of the sector openings 108*a*, 110*a* so that the control plate 120 can be swung to a position at which the sector openings in the cover plates are closed by the control plate 120.

FIG. 6 is a partial perspective view showing a mounting arrangement for the paddle assembly 120 in FIG. 5.

An L bracket 124 is welded or otherwise joined at one side edge 124*a* to the arm exercise bar 36*b*' so that the remaining side of the bracket 124 extends parallel to the axes of the cylindrical cross member 32'. L bracket 126 is joined or otherwise welded at one side edge 126*a* to the leg exercise bar 50*b*' so that the remaining side of bracket 126 extends parallel to the axes of cross member 32'.

Each of the brackets 124, 126 has a series of screw hole openings 128, 130 to enable passage of a number of fastening screws 132 (FIG. 5) for each paddle assembly 102. The thickness of the L brackets 124, 126 in the direction of the screw hole openings 128, 130 is just slightly less than the thickness of each paddle assembly control plate 120.

Each paddle assembly is fixed to its associated L bracket by placing the cover plates 108, 110 with a control plate 120 pivoted between them, on opposite sides of the associated L bracket. The screw hole openings 112, 114 in the cover plates are aligned with the screw hole openings 128 (or 130) in the corresponding L bracket 124 (or 126). The fastening screws 132 are then passed through the aligned openings in the cover plates and the L brackets, and tightened with lock washers and nuts (not shown) to fix the paddle assembly 102 firmly in place.

With the paddle assemblies 102 mounted on each of the exercise bars as described, the resistance or drag on each of the bars when swung under water may be controlled by manually pivoting the control plate 120 against a tight friction fit created by cover plates 108, 110 when tightened about the control plate via fastening screws 132. In the position shown in FIG. 4, the control plates 120 will produce maximum drag upon movement of the associated exercise bar under water. The drag can be reduced to a desired level by swinging the control plate 120 to form an open passage through the paddle assembly 102, so that less water will act against movement of the paddle assembly. With the control plate 120 swung to an extreme end of its path of movement, an opening having an area nearly the same as the sector openings 108*a*, 110*a* in the cover plates 108, 110, may be obtained. Preferably, the cover plates 108, 110 and the control plate 120 are formed of injection molded plastics material, and all screw hardware is stainless steel.

Figure 8:
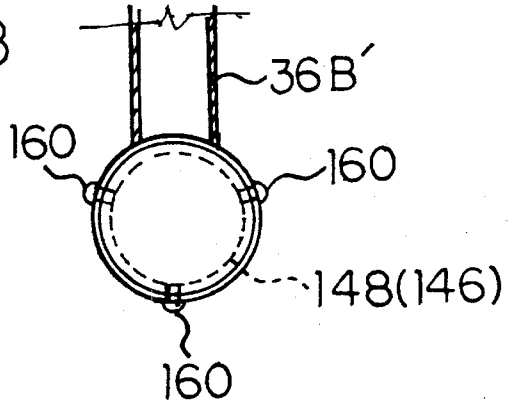
FIG. 8 is a partial side elevational view of the mounting arrangement in FIG. 7.
Figure 7:
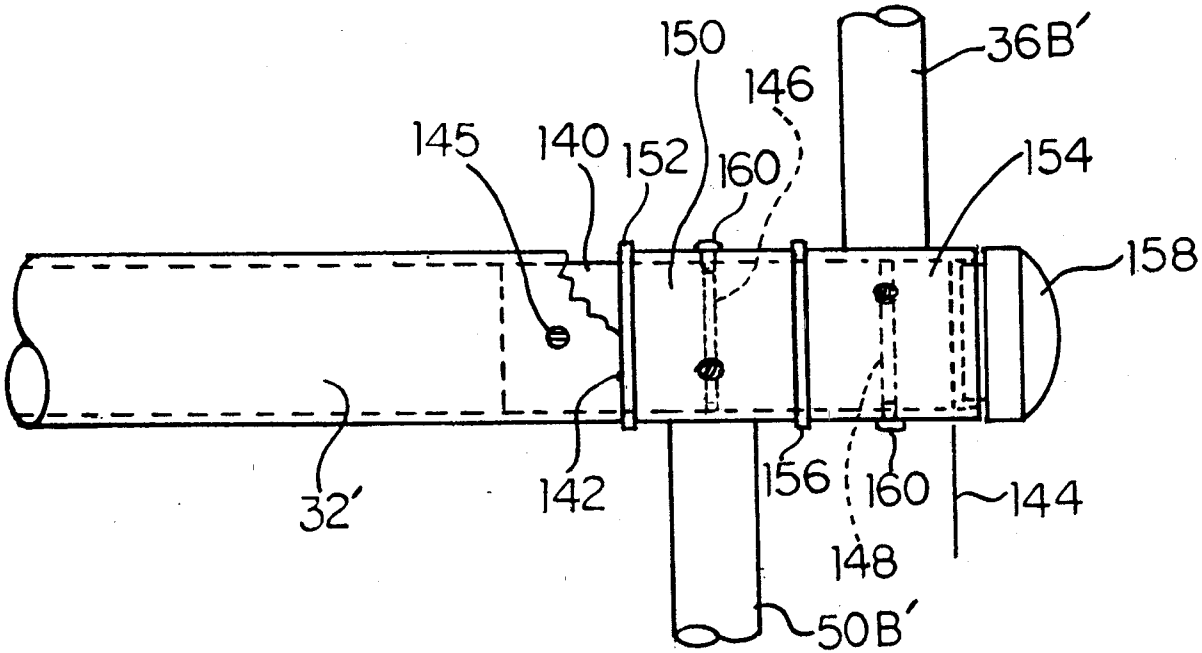
FIG. 7 is a partial front elevational view of a mounting arrangement for arm and leg exercise bars in the equipment of FIG. 4.

FIG. 7 is a partial elevational view showing a mounting arrangement for the arm and the leg exercise bars in the equipment 100 of FIG. 4. FIG. 8 is a partial side elevational view of the mounting arrangement in FIG. 7.

At each end of the cylindrical cross member 32', a solid nylon cylindrical bar 140 extends axially from an end 142 of the cross member 32', to end at 144 The bar 140 is fixed firmly in place with, e.g., at least one locking screw 145 through the wall of the member 32', and has a pair of parallel, spaced apart annular grooves 146, 148 cut in its circumference, as shown. Leg exercise bar 50*b*' has an end bushing 150 mounted co-axially on the bar 140, with a spacer washer 152 mounted on the bar between the end 142 of cross member 32' and the left side of the end bushing 150, as viewed in FIG. 7. Arm exercise bar 36*b*' has an end bushing 154 mounted co-axially on the cylindrical bar 140, and a second spacer washer 156 is disposed between the right side of the end bushing 150 and the left side of the end bushing 154 as seen in FIG. 7. An end cap 158 is secured over the right end of the bushing 154. The end bushings 150, 154 are maintained at fixed axial positions relative to the bar 140, by way of three equi-circumferentially spaced, stainless steel set screws 160 that are threaded through the wall of each bushing 150, 154 to seat within one of the annular grooves in the bar 140. See FIG. 8.

With the above described mounting arrangement for the exercise bars of the equipment 100, it will be appreciated that the bars can be swung independently of one another over large angles, and the water drag acting on each bar can be adjusted individually using the paddle assemblies 102.

FIG. 9 is a view showing details of the mounting arrangement at the right side of cross member 32 for the arm and leg exercise bars 36*b* and 50*b* in the equipment 10 of FIGS. 1–3.

A single pivot shaft or axle 170 extends co-axially through the cylindrical cross member 32. Shaft 170 is fixed with respect to the member 32 by way of suitable retaining means (not shown) inside the member 32, such as one or more bushing members joined concentrically to the shaft 170 and to the inner periphery of the cross member 32.

As shown in FIG. 9, each end portion of the pivot shaft 170 extends axially from an end 172 of the cross member 32, to end at 174. Shaft 170 is threaded at the end 174 to engage mating threads of an end cap knob 176 in a locking fit, so that the knob 176 will not turn freely once advanced to a position over the shaft end 174, as indicated by the arrow.

Leg exercise bar **50*b* has its end bushing 51*b* mounted co-axially over the shaft 170, and arm exercise bar 36*b* has an end bushing 37b mounted co-axially with the shaft 170 with a spacer washer 178 disposed between confronting side ends of the bushings 51*b*, 37*b*. Washer 178 may, if desired, have a certain friction co-efficient on its major surfaces. Another spacer washer 180 is disposed between the left side end of the bushing 51*b* of the leg exercise bar, and the end 172 of cross member 32. Washer 180** may also have a certain surface friction co-efficient.

Before the arm and the leg exercise bars are mounted on the pivot shaft 170, a torsion spring element 182 is inserted in the bars as follows. A spring end arm **182*a* is placed inside the bushing 51*b* of the leg bar 50*b*, and directed through a tight fit opening in the bushing wall toward the inside of bar 50*b* as in FIGS. 9 and 11. The spacer washer 178 is then placed over the exterior part of the spring element 182. The element is then placed inside the bushing 37*b* of the arm exercise bar, and a spring end arm 182*b* is inserted through a tight fit opening in the wall of bushing 37*b* toward the interior of the arm bar 36*b*. See FIGS. 9 and 11. Both end bushings 51*b*, 37*b*, with the washer 178 between them and the spring element 182 inside them, are positioned co-axially over the end of the pivot shaft 170 and moved into the position shown in FIG. 9**.

A spring element retaining and limit stop plate 184 having a circular arc cross-section, is fixed to the inside wall surface of the cross member 32 by way of, e.g., a pair of threaded studs **186*a*, 186*b* that project radially outward through openings in the cross member wall. See FIG. 10**.

The ends of the stop plate 184 project a sufficient distance beyond the ends 172 of cross member 32, so as to extend further than the spring element end arm **182*b* and to abut both end arms 182*a*, 182*b* when arm and leg members 36*b*, 50*b* are swung slightly toward one another about the shaft 170 and against the action of spring element 182, in the direction of the arrows in FIG. 11. The inside diameter of the spring element 182 and the number of turns of the spring element, should be such that when arm and leg members 36*b*, 50*b* are swung individually or together in the direction of the arrows in FIG. 11, the spring element 182 will have sufficient clearance to turn about the shaft 170 and at the same time act to maintain the arm/leg member bushings in alignment on the shaft 170. The stop plate 184** thus defines the initial positions of the exercise bars and acts as a stop against further movement of the bars in the direction opposite to the arrows.

After the bushings **37*b*, 51*b* with the spacer washer 178 and spring element 182 in place are positioned over the shaft 170, a smooth washer 188 is placed over the shaft end 174 to lie against the right side end of bushing 37*b*. A roller bearing 192 having two end plates 192*a*, 192*b* is placed over the shaft end 174, and the knob 176 is tightened on the shaft end flush against the bearing plate 192*b***.

A mounting arrangement identical to that of FIG. 9 is provided at the left side of the cross member 32 for mounting of the arm and the leg members **36*a*, 50*a***.

When using the equipment 10 of FIGS. 1–3, the mounting arrangement and spring action mechanism of FIGS. 9–11 allow a seated person to exercise their arms and legs by urging the corresponding exercise bar forward or upward against the action of the spring elements 182 at both ends of the cross member 32. A person can undergo a total body aerobic workout by, for example, urging the right arm exercise bar and the left leg exercise bar forward and upward in one motion, and then urging the left arm exercise bar and the right leg bar forward and upward in a single motion. Stomach muscles can be developed by urging all the exercise bars forward and upward in a single motion, repeatedly.

While the foregoing description represents a preferred embodiment of the invention, it will be obvious to those skilled in the art that various changes and modifications may be made, without departing the true spirit and scope of the invention. Accordingly, the scope of the invention is to be interpreted and construed in accordance with the following claims.

What I claim is:

1. Aerobic exercise equipment, comprising:

a frame body defining a base portion arranged to rest on a floor surface, and a seat portion including a seat over the base portion for supporting said seat at a certain height above the floor surface when said base portion rests on the floor surface, the seat having a forward edge;

shaft portion means fixed with respect to said frame body and aligned in the region of the forward edge of said seat, for defining a pivot axis;

a left arm exercise bar having an end pivoted on the shaft portion means at a left side of the forward edge of said seat for swinging movement about the pivot axis, and a right arm exercise bar having an end pivoted on the shaft portion means at a right side of the forward edge of said seat for swinging movement about the pivot axis, the left and the right arm exercise bars having grip portions formed to be grasped by a person when seated on said seat to swing said bars about the pivot axis;

a left leg exercise bar having an end pivoted on the shaft portion means at a left side of the forward edge of said seat for swinging movement about the pivot axis, and a right leg exercise bar having an end pivoted on the shaft portion means at a right side of the forward edge of said seat for swinging movement about the pivot axis, the left and the right leg exercise bars having portions formed to engage a seated person's feet to swing the leg exercise bars about the pivot axis; and spring action means associated with the arm and the leg exercise bars on said shaft portion means, for enabling the arm exercise bars to be swung in a forward direction relative to said seat against a force of the spring action means, and for enabling the leg exercise bars to be swung in an upward direction relative to the floor surface against a force of the spring action means, and the spring action means is constructed and arranged to enable the arm and the leg exercise bars to be swung independently of one another.

2. Aerobic exercise equipment according to claim 1, wherein said shaft portion means comprises a pivot shaft defining the pivot axis.

3. Aerobic exercise equipment according to claim 2, wherein said spring action means comprises a torsion spring element arranged coaxially on said pivot shaft, the spring element having end arms for engaging adjacent arm and leg bars at each side of said seat portion.

4. Aerobic exercise equipment according to claim 3, wherein said spring action means includes stop member means fixed to said shaft portion means and abutting the end arms of said spring element, for defining initial positions of the exercise bars and stopping swinging movement of the bars beyond said initial positions in directions opposite to said forward and said upward directions.

5. Aerobic exercise equipment, comprising:

a frame body defining a base portion arranged to rest on a supporting surface, and a seat portion including a seat over the base portion for supporting said seat at a certain height above the supporting surface when said base portion rests on the supporting surface, the seat having a forward edge;

shaft portion means fixed with respect to said frame body and aligned in the region of the forward edge of said seat, for defining a pivot axis;

a left arm exercise bar having an end pivoted on the shaft portion means at a left side of the forward edge of said seat for swinging movement about the pivot axis, and a right arm exercise bar having an end pivoted on the shaft portion means at a right side of the forward edge of said seat for swinging movement about the pivot axis, the left and the right arm exercise bars having grip portions formed to be grasped by a person when seated on said seat to swing said bars about the pivot axis;

a left leg exercise bar having an end pivoted on the shaft portion means at a left side of the forward edge of said seat for swinging movement about the pivot axis, and a right leg exercise bar having an end pivoted on the shaft portion means at a right side of the forward edge of said seat for swinging movement about the pivot axis, the left and the right leg exercise bars having portions formed to engage a seated person's feet to swing the leg exercise bars about the pivot axis; and resistance means associated with the arm and the leg exercise bars, for resisting or dragging against swinging movement of the arm and the leg exercise bars about said pivot axis, wherein the resistance means is constructed and arranged to enable the arm and the leg exercise bars to be swung independently of one another.

6. The exercise equipment of claim 5, wherein said shaft portion means comprises a pivot shaft defining the pivot axis.

7. The exercise equipment of claim 5, wherein the height of said seat above the supporting surface and the position of said shaft portion means, are determined so that a person when seated on said seat can swing their legs about the knees between a position where the person's feet approach the supporting surface beneath the forward edge of the seat, and a position where the person's legs extend straight, while the feet engage said left and said right leg exercise bars.

8. The exercise equipment of claim 5, wherein said frame body comprises left and right, generally "C"-shaped tubular members each having an upper portion and a lower portion, wherein the upper portions of said tubular members form a mount for said seat.

9. The exercise equipment of claim 8, wherein the forward edge of said seat faces in the direction of the open side of a "C" defined by said tubular members.

10. The exercise equipment of claim 8, including an upper cross member joined to upper end portions of the left and the right tubular members, and said upper cross member is aligned in the region of the forward edge of said seat and forms a part of the shaft portion means.

11. The exercise equipment of claim 5, wherein each of the left and the right arm exercise bars has about a 30 degree bend in its central region.

12. Aerobic exercise equipment according to claim 11, wherein said resistance means comprises adjustable drag paddle means associated with each of the arm and the leg exercise bars for resisting swinging movement of the bars when submerged under water, the drag paddle means including a plate member fixed to the associated exercise bar and having a water passage opening to reduce water drag on the plate member as the member swings with the exercise bar, and control means on the plate member for adjustably closing the water passage opening of the plate member to obtain a desired water drag for the swinging bar.

13. Aerobic exercise equipment according to claim 12, wherein the control means of said drag paddle means includes a control plate mounted for sliding movement relative to the plate member to close said water passage opening.

14. Aerobic exercise equipment according to claim 13, wherein said control plate is pivoted to the plate member.

15. Aerobic exercise equipment according to claim 13, wherein the control means comprises a pair of cover plates each having said water passage opening, and said control plate is sandwiched between said cover plates for relative sliding movement.

* * * * *